United States Patent [19]

Rudolph, Jr. et al.

[11] Patent Number: 5,065,646

[45] Date of Patent: Nov. 19, 1991

[54] PROCESS FOR FABRICATING A MOLDBOARD BLADE

[75] Inventors: Leroy Rudolph, Jr.; Dennis A. Brimeyer, both of Dubuque, Iowa

[73] Assignee: Deere & Company, Moline, Ill.

[21] Appl. No.: 557,886

[22] Filed: Jul. 24, 1990

[51] Int. Cl.[5] ..... B21K 19/00

[52] U.S. Cl. ..... 76/101.1

[58] Field of Search ..... 76/101.1; 29/446, 891; 228/173.1, 173.6, 178, 182

*Primary Examiner*—Roscoe V. Parker

[57] ABSTRACT

A process for forming a moldboard blade for a grader by inducing beneficial residual stresses during fabrication. This increases the strength of the blade without adding additional material and weight. The blade is first bowed towards its supporting structure surface. The supporting structure is welded to the blade and the blade is released. The blade is then bent in the opposite direction towards its working surface and released. The blade is then checked to determine if it is straight. If the blade is not straight it is bent again until it is straight.

14 Claims, 3 Drawing Sheets

PROCESS FOR FABRICATING A MOLDBOARD BLADE

BACKGROUND OF THE INVENTION

1. Field of the Invention

The invention is directed to a process of forming a moldboard blade by inducing beneficial residual stresses in the blade, thereby increasing strength of the blade without adding additional material and weight.

2. Description of the Prior Art

In fabricating a moldboard blade for a grader, the assignee of the present invention currently mounts the blade on a welding fixture and bows the blade slightly in the direction of the soon to be mounted supporting structure. The supporting structure is then welded to the backside of the blade. The blade is then released from the fixture and because of the thermal stresses induced in the blade during welding, the blade straightens out and is ready to be mounted on a grader.

SUMMARY

It is an object of the present invention to form a moldboard blade of greater strength without additional weight by inducing beneficial residual stresses in the blade and also strain hardening the blade during fabrication.

A grader moldboard blade of the present invention is first bowed in the direction of the supporting structure. This bowing is greater than the amount of bowing recovered by the thermal stresses induced in the blade when welding the supporting structure to the blades. The supporting structure is welded to the blade after it is bowed. The blade is then released and the blade recovers only a portion of the bow curvature. The blade is then bent in the opposite direction past its intended shape. The blade is then released and compared to the final desired shape. The blade may then be bent again to reach the correct configuration.

DETAILED DESCRIPTION

Figure 1:
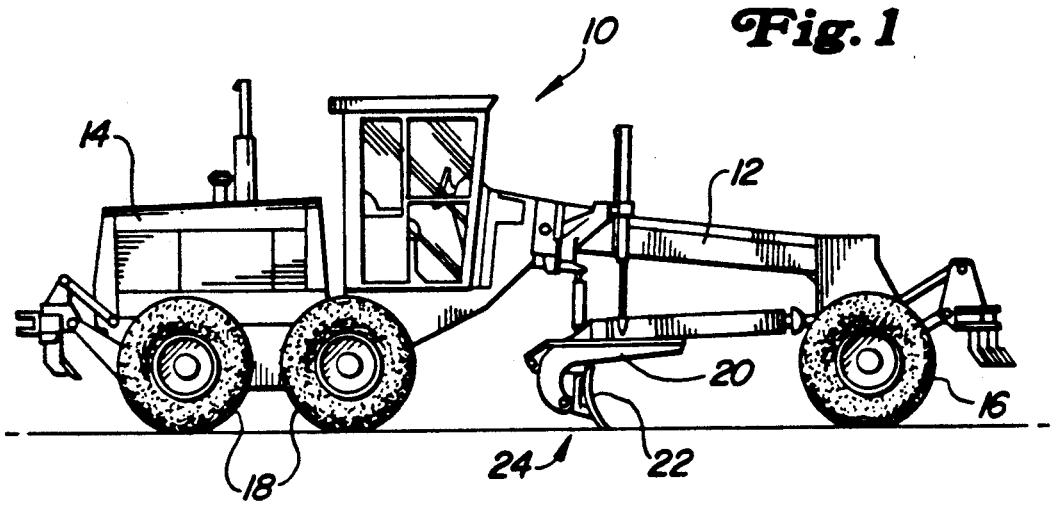
FIG. 1 is a side view of a motor grader.

FIG. 1 illustrates an articulated motor grader 10 comprising a front frame 12 and a rear frame 14. The front frame is supported by wheels 16 and the rear frame is supported by tandem wheels 18. The rear frame 14 houses the engine and transmission of the motor grader. The front frame 12 supports moldboard circle assembly 20 which is used to manipulate the position of the moldboard blade 22. The moldboard blade 22 is supported from the grader moldboard circle assembly by supporting structure 24.

Figure 2:
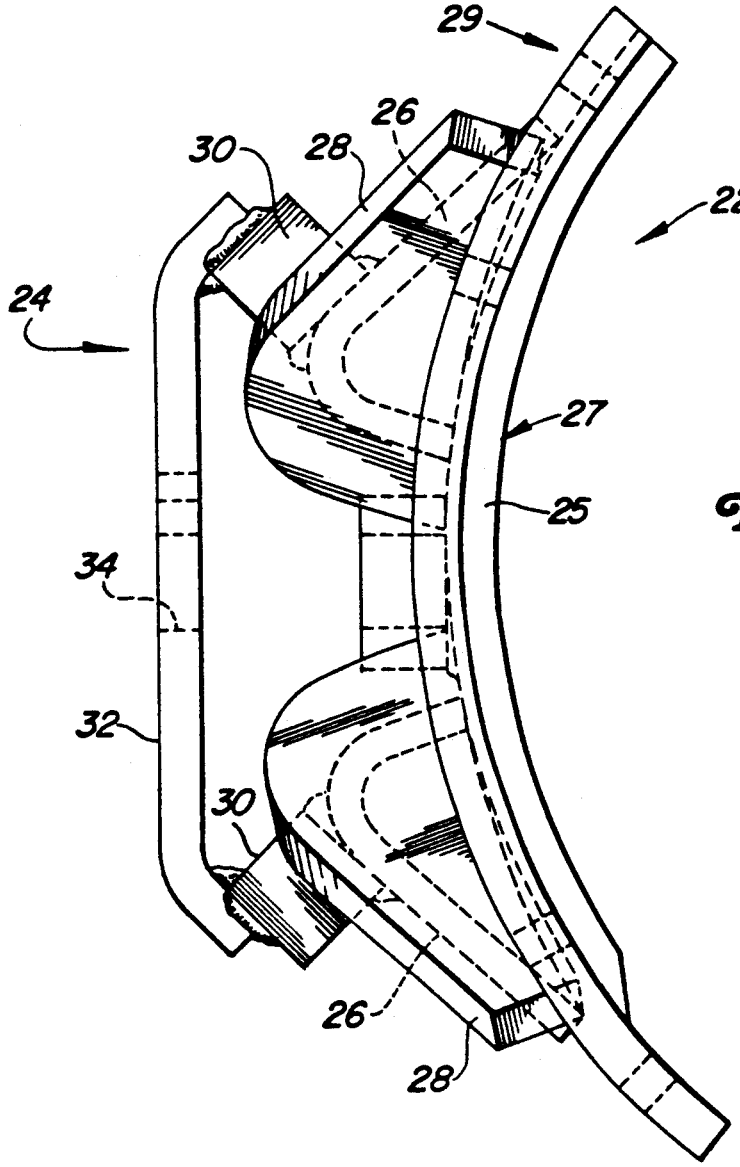
FIG. 2 is an end view of the moldboard blade of the motor grader.
Figure 3:
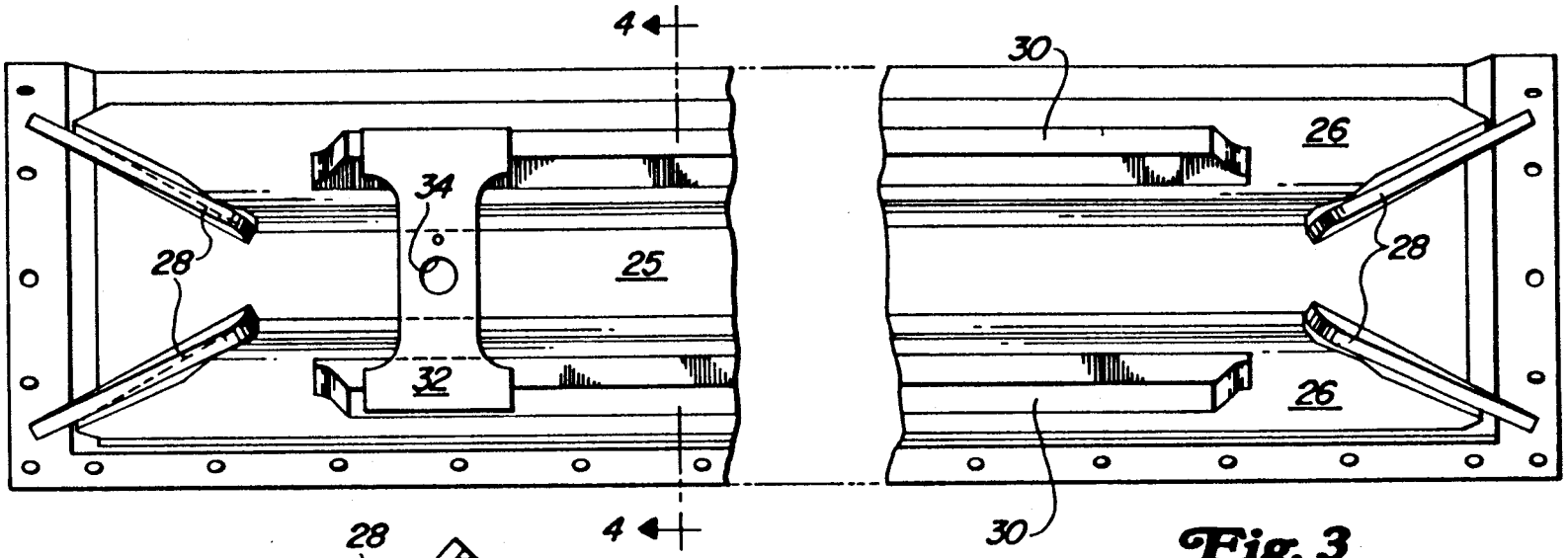
FIG. 3 is a rear view of the moldboard blade of the motor grader.
Figure 4:
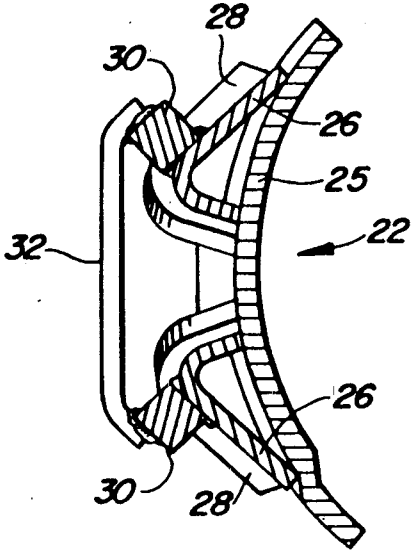
FIG. 4 is a cross sectional view taken along line 4–4.
Figure 5:
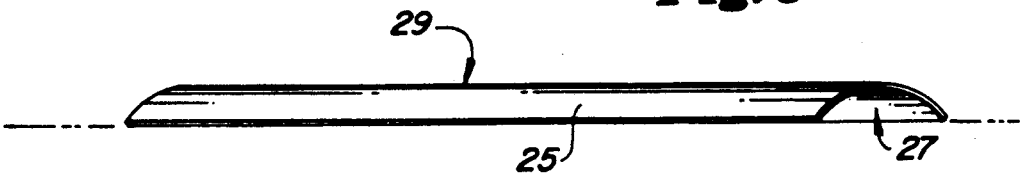
FIGS. 5–9 are views showing the processing steps in fabricating the blade.

As illustrated in FIG. 2, moldboard blade 22 comprises a concave blade member 25 having a working surface 27 and a support structure surface 29. The working surface 27 faces the primary working direction for the moldboard blade. Longitudinal channels 26 are welded to the support structure side of the blade member 25. The ends of these channels are enclosed by plates 28 which are also welded to the channels and the moldboard. Elongated mounting rails 30 are welded to each of the channels. These mounting rails are interconnected by cross member 32 which is welded to these rails. Cross member 32 is provided with an aperture 34 which is coupled to the side shift assembly of the circle assembly. The moldboard blade illustrated if FIGS. 2–4 is of a relatively conventional configuration. The process of fabricating the moldboard blade as discussed below induces beneficial residual stresses in the blade and strain hardens the blade so that it better resists deformation during the grading operation. This process is illustrated in FIGS. 5–9.

Figure 6:
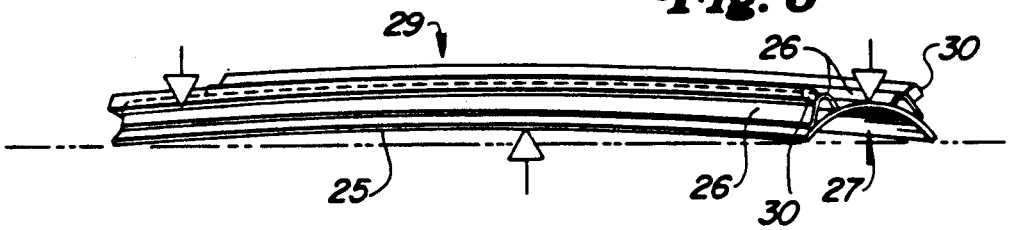

The first step comprises placing an unbent blade member 25 on a welding fixture (not shown) and bowing the blade in the direction of its supporting structure, as illustrated in FIG. 6. This bowing is greater than what is currently done to overcome thermal stresses during the welding process. The bowing maybe accomplished by restraining the ends of the blade member to prevent their upward movement. Then a hydraulic cylinder having a working face conforming to the working surface of the blade member may be positioned towards the center of the blade member. The hydraulic cylinder is driven upwardly so as to form the bow illustrated in FIG. 6.

Figure 7:
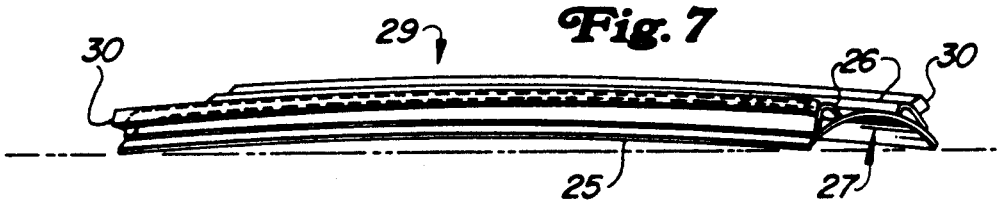

The channels 26 and rails 30 are then welded to the bowed blade member. After welding, the moldboard is released from the fixture. Because of the thermal stresses induced in the moldboard during welding, the moldboard tends to straighten. However, the moldboard still maintains its curved configuration as shown in FIG. 7 when released.

Figure 8:
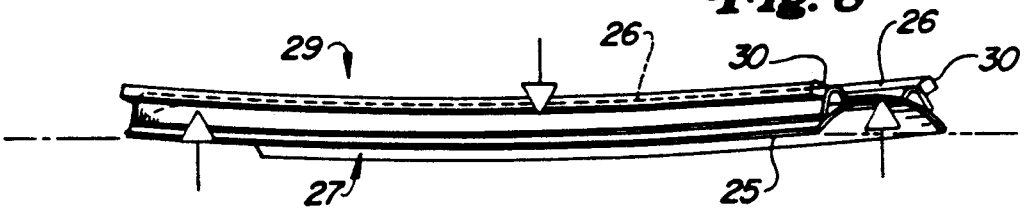
Figure 9:
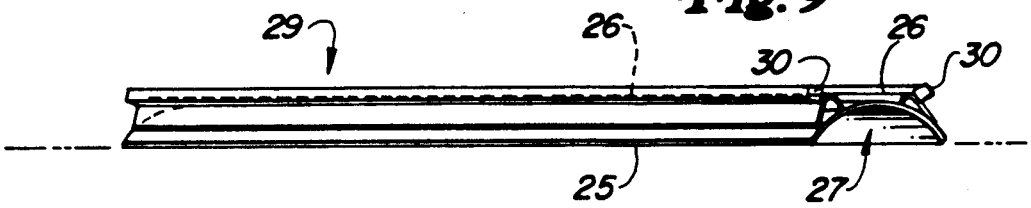

The moldboard blade is then placed in another fixture or press and bent in the opposite direction. The moldboard is bent past its desired shape which with a grader moldboard is a straight configuration, as illustrated in FIG. 8. This bending induces beneficial residual stresses in the moldboard so that it will resist bending from loads coming from the primary working direction and contacting the working side of the moldboard blade during grading operations. This bending is accomplished in a manner similar to that used to bow the blade member. The ends of the blade are restrained from moving downwardly and a hydraulic cylinder or press having a working face conforming to the support structure side of the moldboard blade presses the middle of the moldboard blade downwardly, as illustrated in FIG. 8.

After releasing the moldboard blade from this bending operation, the moldboard blade is compared to its desired shape, which in the case of a grader moldboard blade is straight. If the moldboard blade is still slightly bowed, the moldboard blade can be bent again under greater pressure. The moldboard blade is again released and compared with its desired shape. This process can be repeated until the desired shape is reached. It is important to note however, that the moldboard blade should not be subjected to pressures which bend the moldboard blade so that it exceeds its desired shape and must be rebent in the opposite direction. Bending the moldboard blade in the opposite direction reduces or eliminates the beneficial residual stresses formed in the moldboard blade.

The beneficial residual stresses formed in the moldboard blade are in direct relation to the force used to bend the moldboard blade to its desired shape, (i.e.

greater force produces more beneficial stresses). In addition to these beneficial residual stresses the moldboard blade has also undergone strain hardening which further contributes to the strength of the newly formed blade.

The above described process should not be limited to the above described embodiment, but should be limited solely by the claims that follow.

We claim:

1. A process of fabricating a earthmoving blade having a working surface and a support structure surface, the process comprising the following steps:

bowing the blade towards its support structure surface;

welding a support structure to the bowed blade;

bending the blade and the mounted support structure towards the working surface of the blade;

releasing the blade;

comparing the blade with a final desired shape for the blade; and bending the blade again as necessary to achieve the final desired shape.

2. A process as defined by claim 1 wherein the step of welding a support structure to the bowed blade comprises welding the support structure to the support structure surface of the blade.

3. A process as defined by claim 2 wherein the earthmoving blade is a moldboard blade for a grader.

4. A process as defined by claim 3 wherein the step of welding a support structure to the bowed blade comprises welding longitudinal channels to the blade.

5. A process as defined by claim 4 wherein the final desired shape is straight.

6. An earthmoving blade having a working surface and a support structure surface made by the process comprising the following steps:

bowing the blade toward its support structure surface;

mounting a support structure to the bowed blade;

bending the blade and the mounted support structure towards the working surface of the blade;

releasing the blade;

comparing the blade with a final desired shape for the blade; and bending the blade again as necessary to achieve the final desired shape.

7. An earthmoving blade as defined by claim 6 wherein the step of mounting a support structure to the bowed blade comprises mounting the support structure to the support structure surface of the blade.

8. An earthmoving blade as defined by claim 7 wherein the step of mounting a support structure to the bowed blade comprises welding the support structure to the blade.

9. An earthmoving blade as defined by claim 8 wherein the earthmoving blade is a moldboard blade for a grader.

10. An earthmoving blade as defined by claim 9 wherein the step of mounting a support structure to the bowed blade comprises welding longitudinal channels to the blade.

11. An earthmoving blade as defined by claim 10 wherein the final desired shape is straight.

12. A grader moldboard blade having a primary working direction made by the process comprising the following steps:

bowing the blade away from its primary working direction;

welding a support structure to the bowed blade;

bending the blade and the mounted support structure towards the primary working direction of the blade;

releasing the blade;

comparing the blade to determine if it is straight; and bending the blade again as necessary to achieve a straight moldboard blade.

13. A moldboard blade as defined by claim 12 wherein the step of welding a support structure to the bowed blade comprises welding the support structure to a surface of the blade opposite to the working direction of the blade.

14. A moldboard blade as defined by claim 13 wherein the step of welding a support structure to the bowed blade comprises welding longitudinal channels to the blade.

* * * * *